US006236822B1

(12) United States Patent
Kawaguchi

(10) Patent No.: US 6,236,822 B1
(45) **Date of Patent: *May 22, 2001**

(54) SHUTTER AND PROCESS CARTRIDGE

(75) Inventor: Hideshi Kawaguchi, Toride (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/192,371

(22) Filed: Nov. 16, 1998

(30) Foreign Application Priority Data

Nov. 17, 1997 (JP) ..... 9-332495
Nov. 10, 1998 (JP) ..... 10-334981

(51) Int. Cl.[7] ..... G03G 21/00
(52) U.S. Cl. ..... 399/114; 399/116
(58) Field of Search ..... 399/114, 116, 399/111, 159

(56) References Cited

U.S. PATENT DOCUMENTS 4,829,334 * 5/1989 Takamatsu et al. ..... 399/114
5,266,999 * 11/1993 Yashiro ..... 399/114
5,642,187 6/1997 Nomura et al. .
5,650,841 7/1997 Matsuda et al. .
5,678,139 10/1997 Nomura et al. .
5,697,017 * 12/1997 Rooke et al. ..... 399/71
5,697,022 12/1997 Matsuda et al. .
5,729,796 * 3/1998 Miura et al. ..... 399/114
5,825,472 10/1998 Araki et al. .
5,878,304 * 3/1999 Watanabe et al. ..... 399/92
5,907,751 5/1999 Kawaguchi et al. .

* cited by examiner

*Primary Examiner*—Richard Moses
(74) *Attorney, Agent, or Firm*—Fitzpatrick, Cella, Harper & Scinto

(57) ABSTRACT

This invention relates to shutter to be used in a process cartridge detachably mountable to the electrophotographic image forming apparatus and protects an electrophotographic photosensitive drum provided in the process cartridge. The shutter includes (a) a protective portion mounted on the photosensitive drum along the longitudinal direction thereof for protecting the photosensitive drum, when the shutter is mounted on the process cartridge, (b) outward protruding portions provided at one end and the other end of the protective portion in the longitudinal direction thereof so as to protrude from the surface thereof positioned outside when the shutter is mounted on the process cartridge, the outward protruding portions being positioned outside an image forming area of the photosensitive drum in the longitudinal direction of the protective portion, and (c) inward protruding portions provided at one end and the other end of the protective portion in the longitudinal direction thereof so as to protrude from the surface thereof positioned inside when the shutter is mounted on the process cartridge.

16 Claims, 18 Drawing Sheets

SHUTTER AND PROCESS CARTRIDGE

BACKGROUND OF THE INVENTION

1. Field of the Invention

The present invention relates to a shutter employed in a process cartridge and to a process cartridge.

The above-mentioned process cartridge integrally includes charging means, developing means or cleaning means, and an electrophotographic photosensitive drum integrated into a cartridge and is detachably mounted on the main body of the electrophotographic image forming apparatus. Otherwise the process cartridge integrally includes at least one of the cartridge means, developing and cleaning means, and the electrophotographic photosensitive drum and is detachably mounted on the main body of the electrophotographic image forming apparatus. Otherwise it includes the electrophotographic photosensitive drum and is detachably mounted on the main body of the electrophotographic image forming apparatus.

The electrophotographic image forming apparatus is designed to form an image on a recording medium by an electrophotographic image forming process. Examples of such apparatus include an electrophotographic copying apparatus, an electrophotographic printer (such as an LED printer or a laser beam printer), an electrophotographic facsimile apparatus, and an electrophotographic word processor.

2. Related Background Art

In the electrophotographic image forming apparatus employing the electrophotographic image forming process, there is conventionally employed a process cartridge system in which the electrophotographic photosensitive member and process means, acting on the electrophotographic photosensitive member, are formed as an integral cartridge, which is detachably mounted in the main body of the electrophotographic image forming apparatus. Such process cartridge can significantly improve operability since the maintenance of the apparatus can be executed by the user himself, not requiring him to call for service personnel. For this reason, such process cartridge system is widely adopted in electrophotographic image forming apparatus.

Such process cartridge may be singly taken out, for example in a replacing operation, from the main body of the apparatus. It is therefore necessary to protect the electrophotographic photosensitive member from the deposition of dust or the like and from damage.

For this reason, the process cartridge is often provided with a drum shutter as a protective member, for protecting the photosensitive drum and for light shielding of the interior of the process cartridge.

The present invention is designed to extend the prior technology.

SUMMARY OF THE INVENTION

An object of the present invention is to provide a shutter and a process cartridge capable of protecting the electrophotographic photosensitive drum from being damaged.

Another object of the present invention is to provide a shutter and a process cartridge, free from damaging the surface of the electrophotographic photosensitive drum by being bent when the shutter is in the closed position.

Still another object of the present invention is to provide a shutter and a process cartridge, so constructed as to bend toward the outside when the shutter is in the closed position.

Still another object of the present invention is to provide a shutter and a process cartridge, comprising:

(a) a protective portion to be mounted along the longitudinal direction of the electrophotographic photosensitive drum for protecting the electrophotographic photosensitive drum when the shutter is mounted on the process cartridge;

(b) outward protruding portions provided at an end and at the other end of the protective portion so as to protrude from the surface thereof positioned outside when the shutter is mounted on the process cartridge; and (c) inward protruding portions provided at an end and at the other end of the protective portion so as to protrude from the surface thereof positioned inside when the shutter is mounted on the process cartridge. The inward protruding portions are provided between the outward protruding portions in the longitudinal direction of the protective portion.

DESCRIPTION OF THE PREFERRED EMBODIMENTS

[Embodiment 1]

In the following there will be explained, with reference to FIGS. 1 to 5, a process cartridge of a first embodiment and an image forming apparatus capable of mounting such process cartridge. At first reference is made to FIGS. 2 and 3 for explaining the entire configuration of the process cartridge and the image forming apparatus capable of mounting the same, and to FIGS. 1 and 2 for explaining a drum shutter.

The above-mentioned process cartridge integrally includes charging means, developing means or cleaning means and an electrophotographic photosensitive drum in a cartridge, and is detachably mounted on the main body of the electrophotographic image forming apparatus. Otherwise the above-mentioned process cartridge integrally includes at least one of charging means, developing means and cleaning means and an electrophotographic photosensitive drum in a cartridge, and is detachably mounted on the main body of the electrophotographic image forming apparatus. Otherwise the cartridge integrally includes at least the developing means and the electrophotographic photosensitive drum and is detachably mounted on the main body of the electrophotographic image forming apparatus.

[Entire Configuration]

Figure 3:
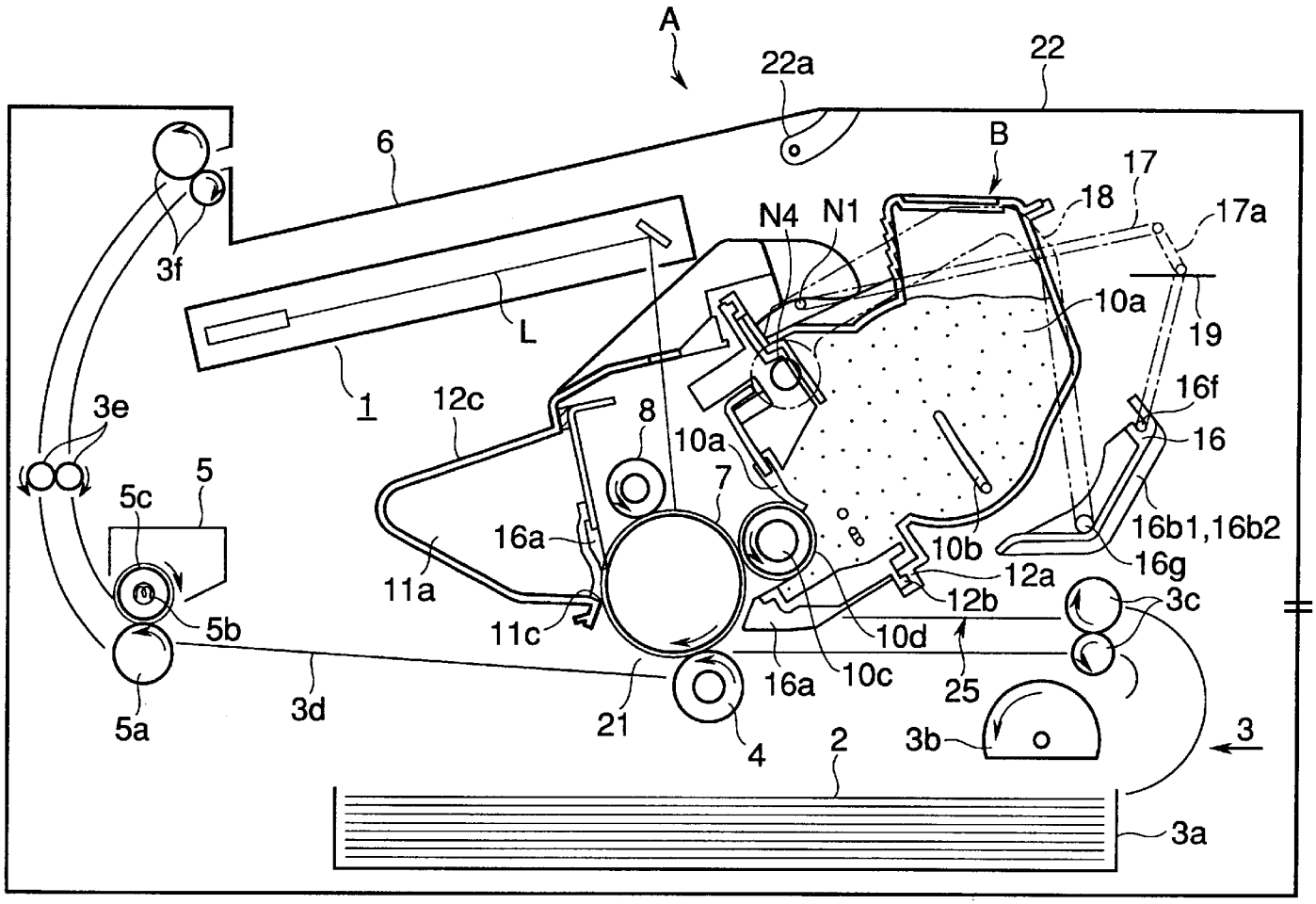
FIG. 3 is a schematic cross-sectional view of an image forming apparatus, utilizing the process cartridge of the first embodiment of the present invention.

In the electrophotographic image forming apparatus (laser beam printer) A, as shown in FIG. 3, a laser beam L emitted from an optical system 1 and modulated according to image information irradiates a drum-shaped electrophotographic photosensitive member (hereinafter called photosensitive drum) whereby a latent image is formed on the photosensitive drum. The latent image is then developed into a toner image. In synchronization with the formation of the toner image, a recording medium 2 is transported from a sheet cassette 3*a* by transporting means 3 composed of a pickup roller 3*b* and paired transport rollers 3*c*. The toner image formed on the photosensitive drum is transferred onto the recording medium 2 by the application of a voltage to a transfer roller 4 constituting transfer means. The recording medium 2 is then guided by a guide plate 3*d* and is transported to fixing means. The fixing means 5 is provided with a driving roller 5*a* and a fixing roller 5*c* incorporating a heater 5*b*, and applies heat and pressure to the passing recording medium 2 thereby fixing the transferred toner image. Subsequently the recording medium 2 is transported by paired discharge rollers 3*e*, 3*f* and is discharged to a discharge unit 6 through an inverting path.

Figure 2:
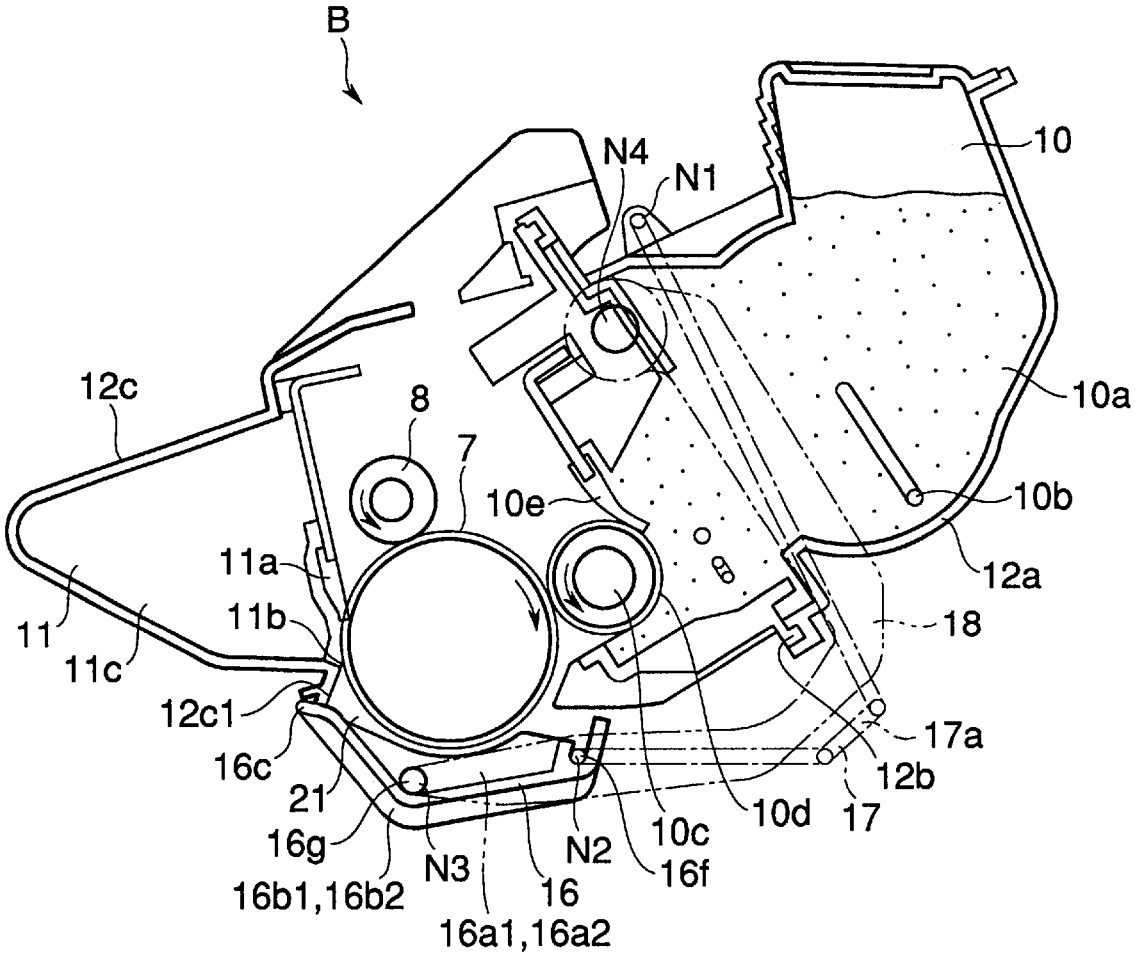
FIG. 2 is a schematic cross-sectional view of the process cartridge of the first embodiment of the present invention, in a direction perpendicular to the center line of the photosensitive drum.

As shown in FIG. 2, the process cartridge B of the present embodiment is for rotating a photosensitive drum 7 uniformly charging the surface thereof by voltage application to a charging roller 8 constituting charging means, exposing the photosensitive drum 7 to the information-bearing light beam L from the optical system 1, thereby forming a latent image, and developing the latent image by developing means 10. The developing means 10 is for feeding the toner in a toner container 10*a* by a toner feeding member 10*b*, rotating a developing roller 10*d* incorporating a fixed magnet 10*c*, forming a toner layer having a triboelectric charge caused by a developing blade 10*e* on the surface of the developing roller 10*d*, and transferring the toner to the photosensitive drum 7 according to the latent image, thereby forming a visible toner image.

Then the toner image is transferred onto the recording sheet 2 by the application to the transfer roller 4 of a voltage of a polarity opposite to that of the toner image. Subsequently, the toner remaining on the photosensitive drum 7 is scraped off by a cleaning blade 11*a*, then scooped up by a scooping sheet 11*b*, and is collected in a used toner container 11*c*. In this manner the toner remaining on the photosensitive drum 7 is eliminated by the cleaning means 11.

A developing unit is formed by fusing the toner container 12*a* with a developing frame 12*b* supporting developing members, such as the developing roller 10*d*. The developing unit is positioned with a cleaning unit supporting the photosensitive drum 7, the cleaning means 11 etc. in a cleaning frame 12*c*. Thus, the above-mentioned components are housed in the above-described cartridge frame as a cartridge, which is detachably mounted on cartridge mounting means provided in a main body 13 of the apparatus.

In the following there will be explained, with reference to FIGS. 1 to 3, a protective member (hereinafter called "drum shutter") for the electrophotographic photosensitive member.

The drum shutter is mounted on the process cartridge B in such a manner as to be freely opened or closed from a closed state shown in FIG. 2 to an open state shown in FIG. 3, by a 4-articulation link mechanism. The drum shutter is composed of the following four components as shown in FIG. 2, namely (i) a shutter cover 16 constituting a protective member for a transfer aperture 21 opposed to a transfer roller 4; (ii) a second arm 18 whose front end at a longitudinal end (in the axial direction of the photosensitive drum 7) of the shutter cover 16 rotatably supports the shutter cover 16 by a pin-shaped articulation N3 and whose base end is rotatably linked to a dowel-shaped articulation N4 provided on the cartridge frame at a longitudinal end thereof; (iii) a first arm 17 whose front end rotatably supports the shutter cover 16 by articulations N2 provided on both longitudinal ends of the shutter cover 16 and whose base end is rotatably linked to a pin-shaped articulation N1 provided on the cartridge frame; and (iv) an unrepresented torsion coil spring (not shown) which is inserted on the dowel-shaped articulation N4, one end of which engages the cartridge frame while the other end of which engages with the second arm 18, thereby clockwise biasing the second arm 18 about the dowel-shaped articulation N4.

The articulation N2, connecting the first arm 17 with the shutter cover 16, is so integrally formed as to connect the first arms 17 at the left and right sides of the process cartridge B. The first arms 17 are provided with hook portions 17*a* protruding respectively toward the both sides in the longitudinal direction.

Referring to FIG. 3, when a cover 22 of the main body of the apparatus is opened by rotation upward about a hinge 22*a*, there appear guide rails (not shown) on lateral walls of the main body. Guide members (not shown) provided on both longitudinal ends of the process cartridge B are fitted into the guide rails whereby the process cartridge B is controlled in its position and is mounted in a position shown in FIG. 3. When the process cartridge B moves to the mounted position, the hook portion 17*a* of the first arm 17 impinges on a fixed portion 19 of the main body of the apparatus and is stopped, whereby the first and second arms 17, 19 of the drum shutter rotate counterclockwise about the articulations N1, N4 in FIG. 1 relative to the cartridge frame, and the shutter cover 16 opens the transfer aperture 21.

Figure 1:
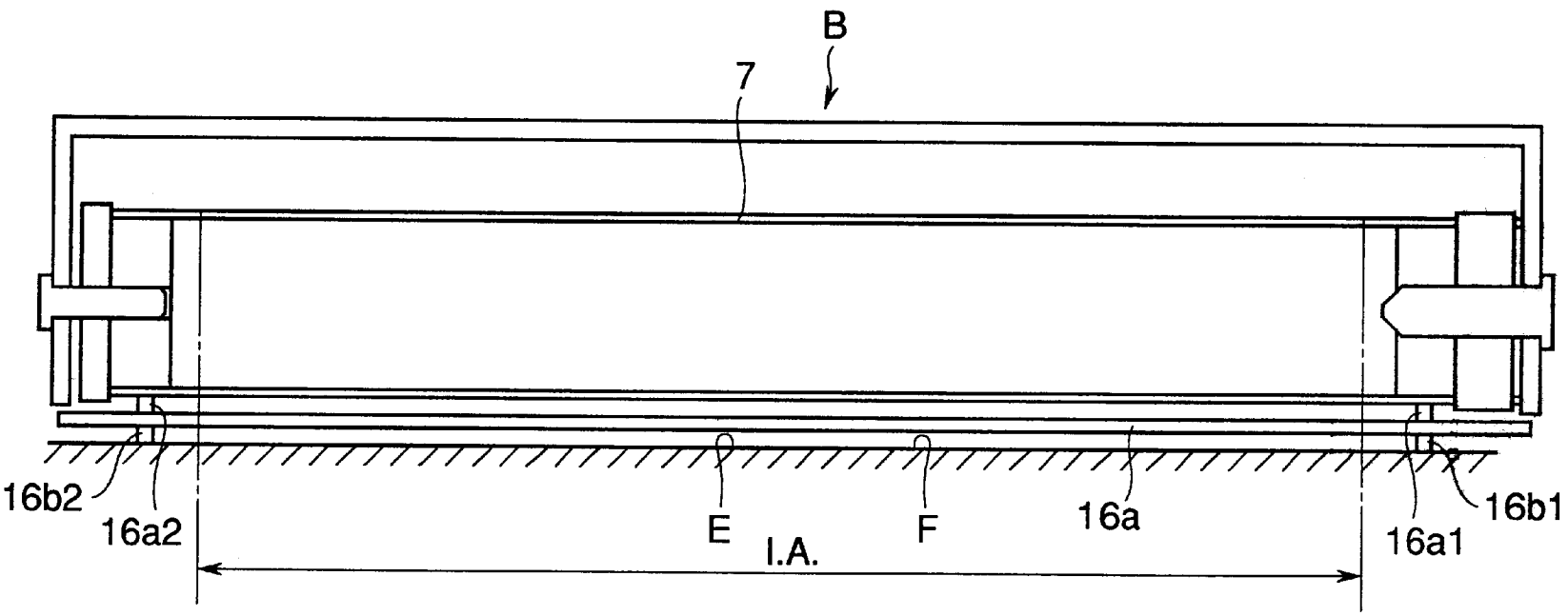
FIG. 1 is a schematic cross-sectional view of a process cartridge constituting a first embodiment of the present invention, along the center line of the photosensitive drum.

When the process cartridge B is taken out from the main body of the apparatus, the first and second arms 17, 18 rotate clockwise about the articulations N1, N4 in FIG. 1, by the force of the torsion coil spring (not shown) provided on the articulation N4 relative to the cartridge frame, whereby the shutter cover 16 closes the transfer aperture 21.

In the image forming apparatus A, as shown in FIG. 3, the shutter cover 16 of the drum shutter is maintained in a position separate from the photosensitive drum 7 whereby the image forming process can be executed.

In the process cartridge B, in a state taken out from the image forming apparatus A, an end 16*c* of the shutter cover 16 impinges on an edge portion 12*c*1 of the cleaning frame 12*c* to close the drum shutter whereby the photosensitive drum 7 is protected from being exposed.

As shown in FIGS. 1 and 2, the shutter cover 16 of the drum shutter is provided, on both sides of the image area I.A., with projections 16*a*1, 16*a*2 on the inner side opposed to the photosensitive drum 7, and with projections 16*b*1, 16*b*2 on the opposite outer side. These projections are formed over substantially the entire width of the shutter cover 16, extending in the moving direction of the shutter cover 16, namely in the shorter direction perpendicular to the longitudinal direction parallel to the axis of the photosensitive drum 7 (cf. FIG. 2).

Thus, when the process cartridge B is taken out from the image forming apparatus A and is placed for example on a desk, the drum shutter is subjected to the weight of the process cartridge B itself, whereby the desk surface F comes into contact with the projections 16*b*1, 16*b*2 while the photosensitive drum 7 comes into contact with the projections 16*a*1, 16*a*2. Owing to these projections, the drum shutter forms spaces between the photosensitive drum 7 and the desk surface F in the image area I.A.

All these projections are positioned outside the image area I.A., thus even if the process cartridge B is so placed on the desk surface F that a small piece E such as a paper clip present on the desk surface F is inside the image area I.A., such small piece E does not contact the drum shutter by the thus formed space. Also even if the process cartridge B is placed with a strong impact on the desk surface F, there is not induced a contact between the photosensitive drum 7 and an area of the drum shutter covering the image area as a result of vibration of the drum shutter, since the desk surface F does not come into direct contact with such area of the drum shutter covering the image area.

[Embodiment 2]

In the following there will be shown a drum shutter which is more resistant, than the first embodiment, to the placement with impact.

Figure 4:
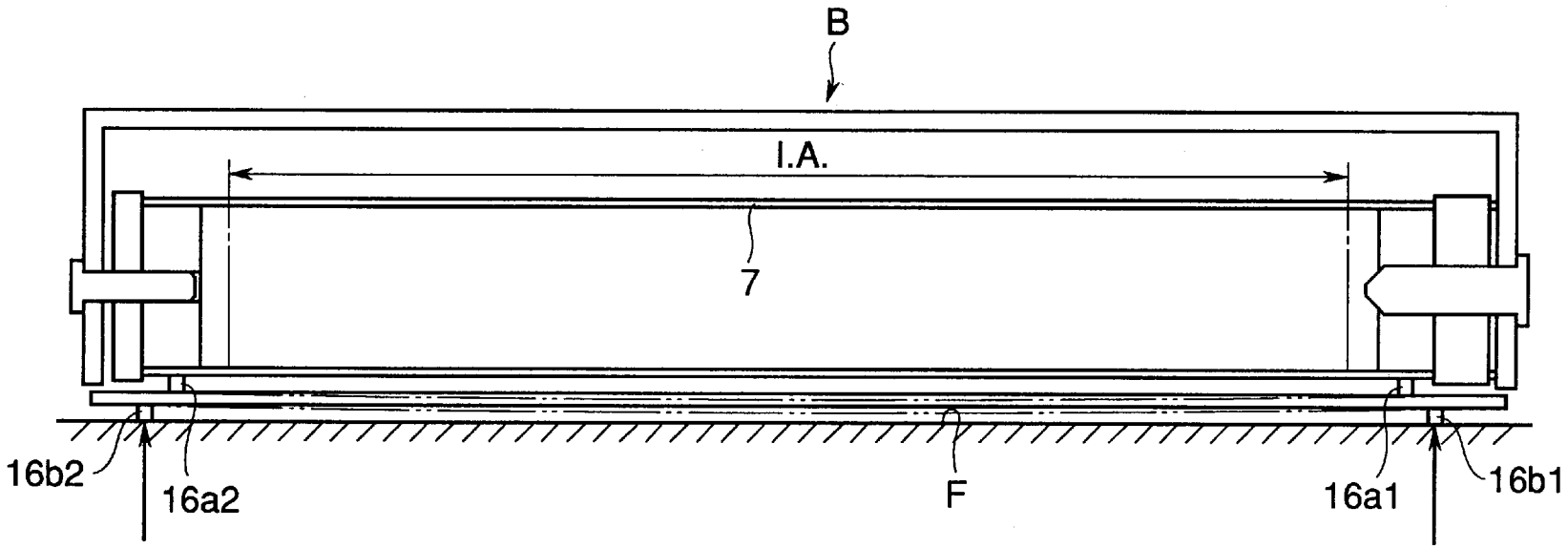
FIG. 4 is a schematic cross-sectional view of a process cartridge constituting a second embodiment of the present invention, along the center line of the photosensitive drum.

The second embodiment is shown in FIG. 4, in which the projections 16*a*1, 16*a*2 on the inner side (facing the photosensitive drum 7) are positioned, in the longitudinal (axial) direction of the photosensitive drum 7, inside the projections 16*b*1, 16*b*2 on the opposite outer side.

When the process cartridge B is placed with a strong impact on the desk surface F, the process cartridge B receives a reactive force as indicated by an upward arrow shown in FIG. 4. In this state, since the projections 16*a*1, 16*a*2 on the inner side facing the photosensitive drum 7 are positioned, with respect to the image area I.A., inside the projections 16*b*1, 16*b*2 on the opposite outer side, the area of the drum shutter covering the image area I.A. is bent in a direction away from the photosensitive drum 7, with a peak displacement in the vicinity of the center thereof. More specifically, there is assumed a form as shown by a chain line in FIG. 4. In this manner the external force acting on the drum shutter so works as to separate the drum shutter from the photosensitive drum 7.

[Embodiment 3]

In the following there will be explained a third embodiment with reference to FIGS. 3 and 5 to 10.

Figure 5:
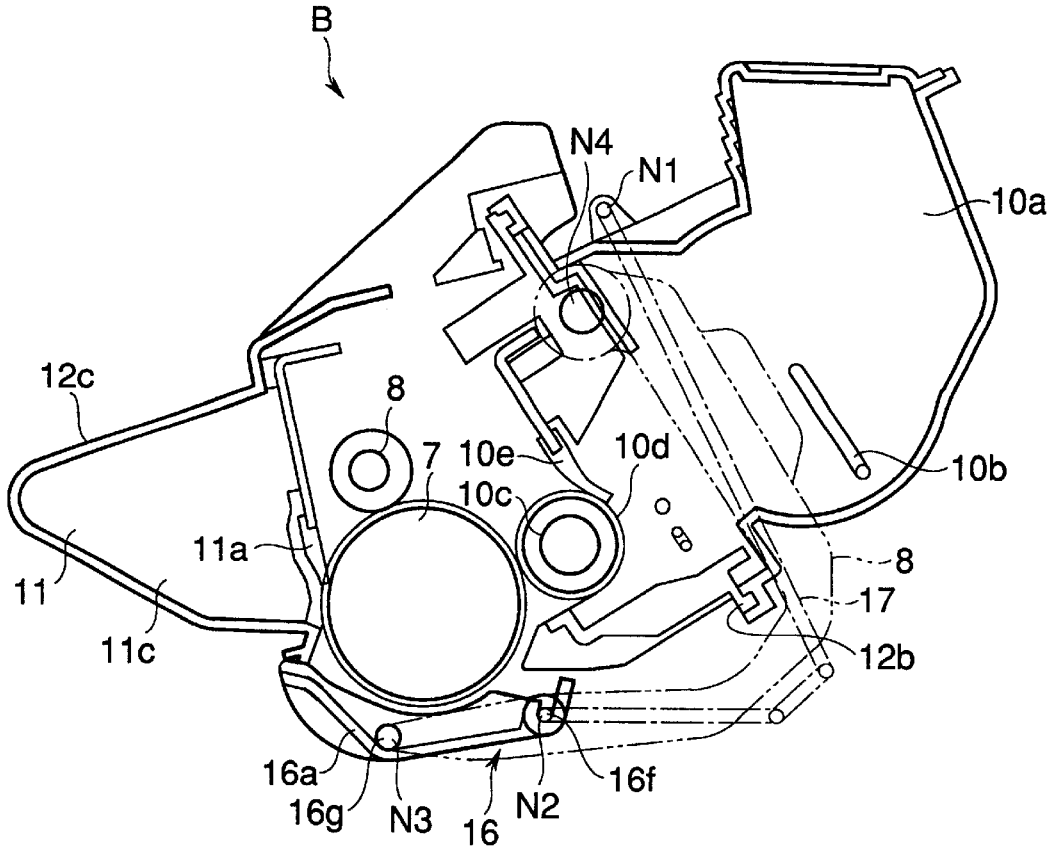
FIG. 5 is a schematic cross-sectional view of the process cartridge of the second embodiment of the present invention.

As shown in FIG. 5, the shutter cover 16 is mounted on the process cartridge B, as a 4-articulation link mechanism at an end in the longitudinal direction (axial direction of the photosensitive drum 7), and the first arm 17 is mounted on the other end in the longitudinal direction. The three arms consist of a first arm 17 (indicated by a double-dot chain line), a second arm 18 (indicated by a single-dot chain line) and the shutter cover 16. The four articulations N1, N2, N3 and N4 consist of articulations N1, N4 for rotatably supporting ends of the first arm 17 and the second arm 18 on the cartridge frame, and articulations N2, N3 supporting the shutter cover 16. Thus, the drum shutter is constituted by a 4-articulation link mechanism, formed by providing the fixed articulations N1, N4 on the cartridge frame and supporting the shutter cover 16 by the first and second arms 17, 18.

Figure 8:
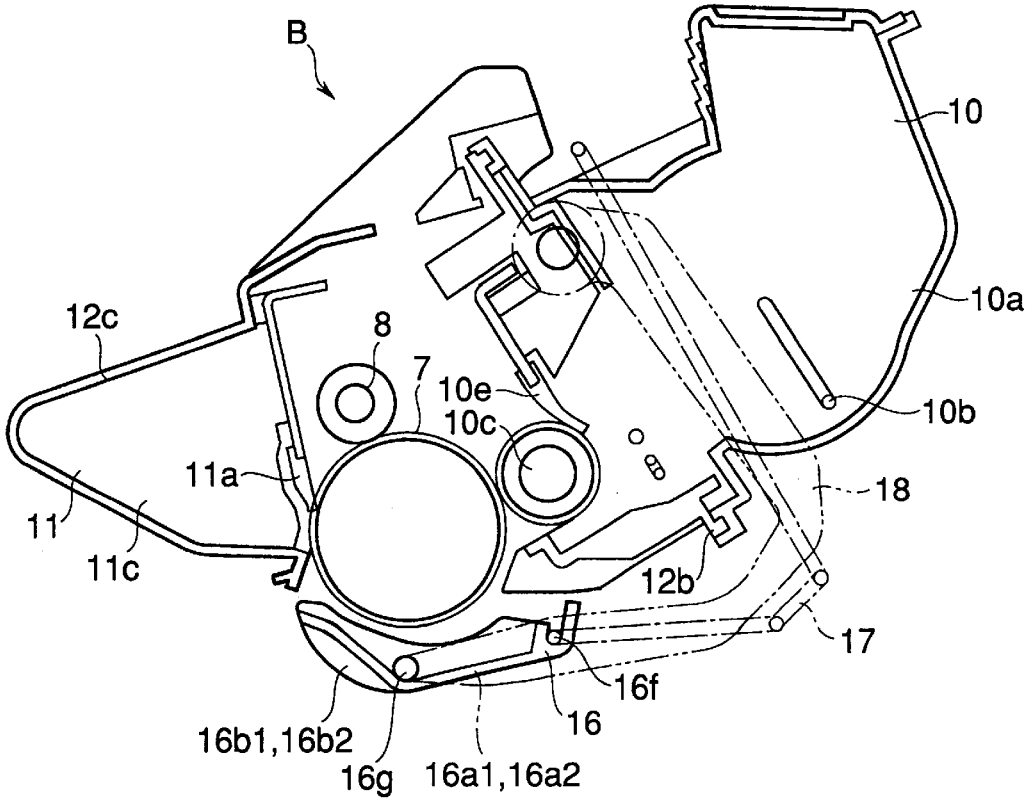
FIGS. 8 and 9 are views showing the states of opening of the drum shutter of the first embodiment of the present invention.
Figure 9:
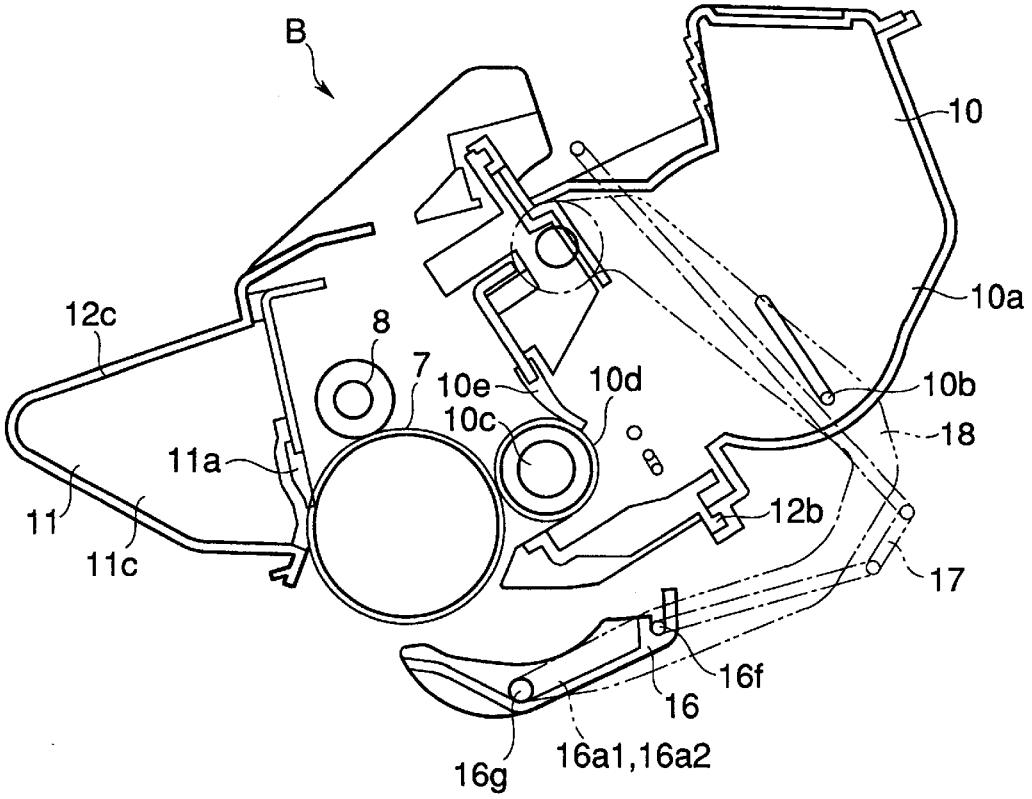
Figure 10:
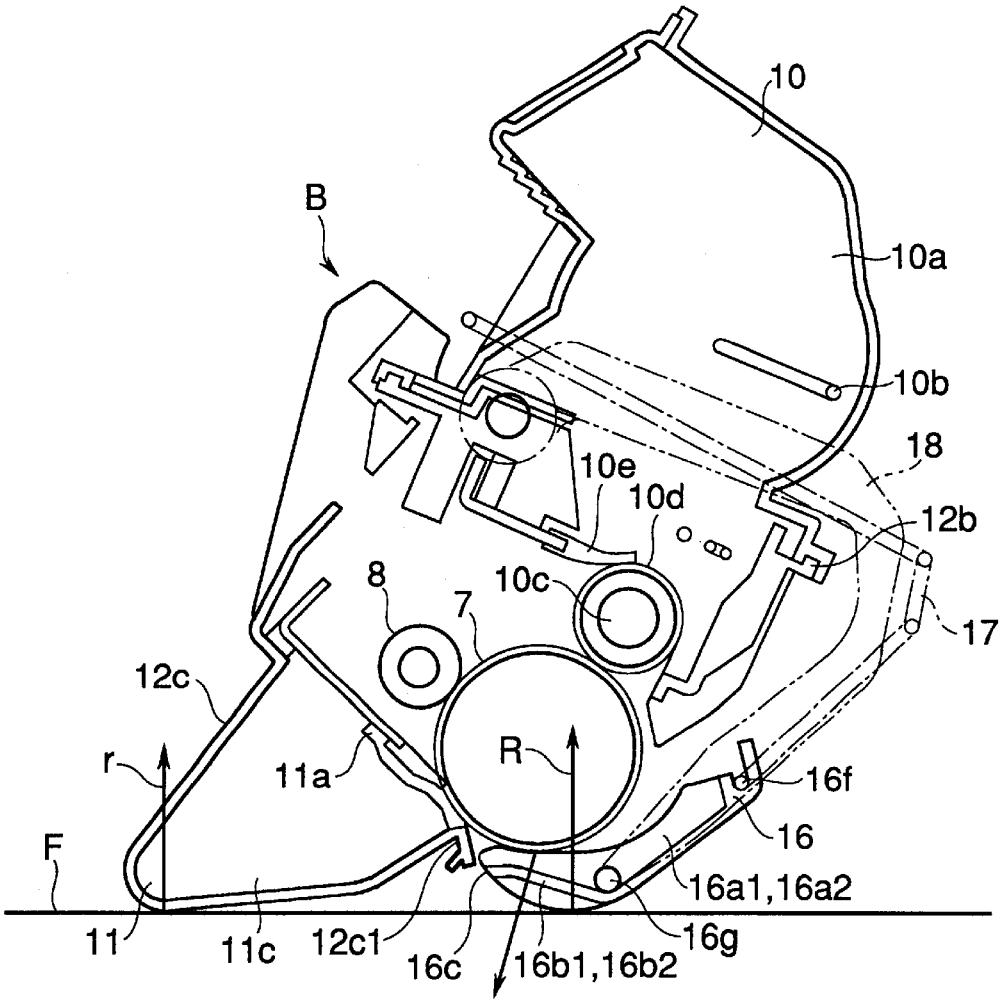
FIG. 10 is a view showing a drum shutter of a third embodiment of the present invention, in a state in contact with the photosensitive drum.

Owing to the above-described link mechanism, the drum shutter can freely move from the closed state shown in FIG. 5, through the states shown in FIGS. 8 and 9, to the open state shown in FIG. 3, without touching the photosensitive drum 7.

When the process cartridge B is taken out from the image forming apparatus A, the drum shutter assumes the closed state shown in FIG. 5, thereby preventing the photosensitive drum 7 from being exposed.

In the image forming apparatus A, the hook portions 17*a* protruding on both sides of the longitudinal direction of the first arm 17 engages with and are supported by the predetermined fixed portion 19 in the image forming apparatus A as shown in FIG. 3, whereby the drum shutter is maintained in a position separate from the photosensitive drum 7, thereby enabling image forming operation.

In the following there will be considered the force applied to the drum shutter and the function of such force, in case the above-described process cartridge B is taken out from the image forming apparatus A and is placed, for example, on a desk. When the process cartridge B is taken out from the image forming apparatus A and is placed on the desk, the drum shutter receives, from the desk surface F, a reactive forces R, r to the weight of the drum shutter and the force applied by the operator unconsciously, as shown in FIGS. 6 and 7.

Figure 6:
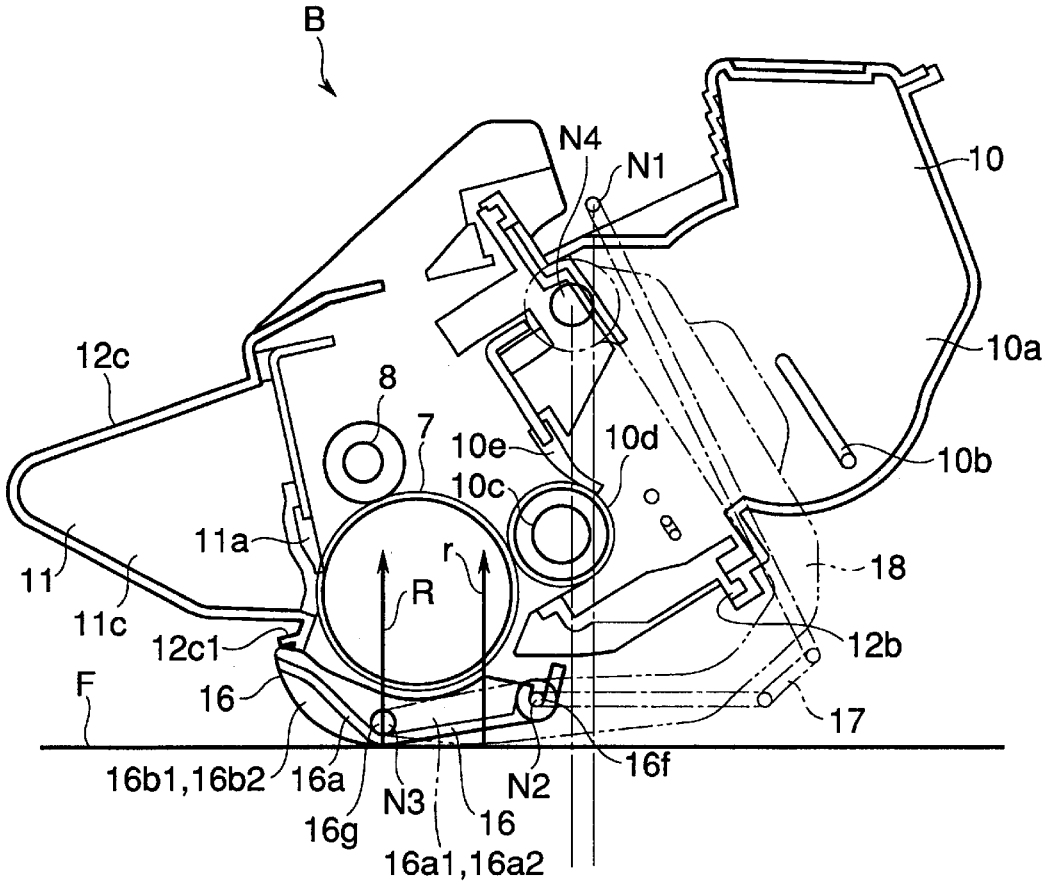
FIGS. 6 and 7 are schematic cross-sectional views of a process cartridge constituting a third embodiment of the present invention, showing a state when the process cartridge is placed on a horizontal surface.

In the case of the reactive forces R, r are positioned at the left side of the articulations N1, N4 and function to close the drum shutter as shown in FIG. 6, the drum shutter stably remains in the closed state, with the end 16*c* of the shutter cover 16 being pressed to the edge 12*c*1 of the cleaning frame 12.

Figure 7:
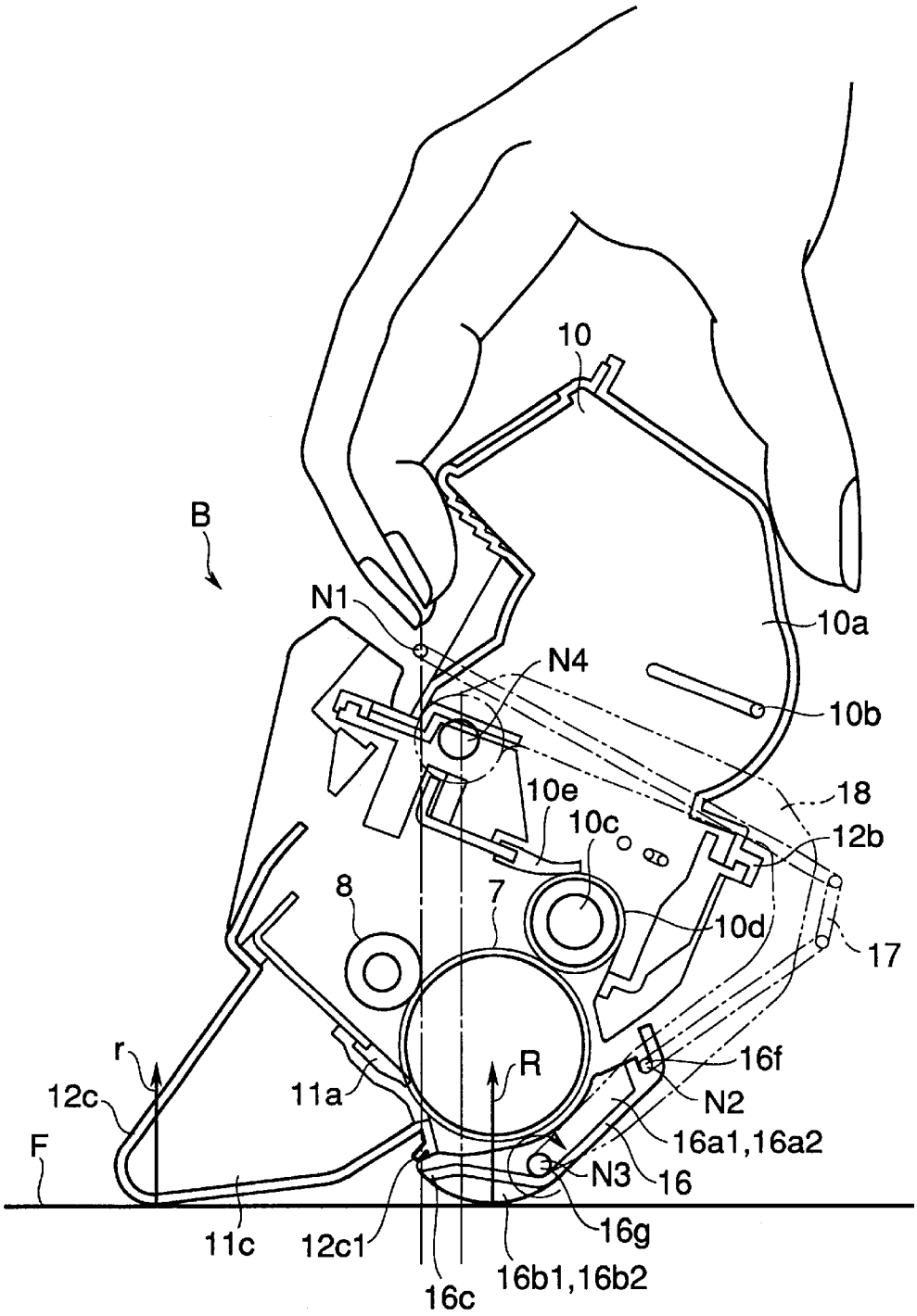

In case the process cartridge B is placed on the surface F in such a manner that the used toner container 11*c* of the cleaning frame 12*c* and the projections 16*b*1, 16*b*2 of the shutter cover 16 come into contact with the surface F, and if the reactive force R is positioned at the right side of the articulations N1, N4 to generate a moment in the direction of opening the drum shutter 16 as shown in FIG. 7, the drum shutter 16 tends to be opened by such reactive force.

In the state shown in FIG. 7, the drum shutter is opened by the reactive force R from the closed state shown in FIG. 2 and through the states shown in FIGS. 8 and 9 as explained in the foregoing, whereby the photosensitive drum becomes eventually exposed.

In the present embodiment, the first and second arms 17, 18 are made flexible. For this reason, the arms 17, 18 are bent by the reactive force R transmitted from the desk surface F through the shutter cover 16. On the other hand, the shutter cover 16 receives such a force that the portion in contact with the desk surface F approaches the photosensitive drum 7. The shutter cover 16 opens with the first and second arms 17, 18 in such state. When it is opened to a state shown in FIG. 10 in which the end 16*c* of the shutter cover 16 is detached from the edge 12*c*1 of the cleaning frame 12, the projections 16*a*1, 16*a*2 of the shutter cover 16 come into contact with the photosensitive drum 17 and serve as stoppers, whereby the shutter cover 16 terminates the opening operation.

Thus the drum shutter is prevented from complete opening, by a configuration in which the first and second arms 17, 18 are flexible and the shutter cover 16 can come into contact with the photosensitive drum 17.

In the above-described configuration, the first arm 17 is composed of a steel wire such as SWB, while the second arm 18 is composed of a resinous material, such as POM or ABS.

[Embodiment 4]

In the following there will be explained a fourth embodiment with reference to FIGS. 11 to 14.

Figure 11:
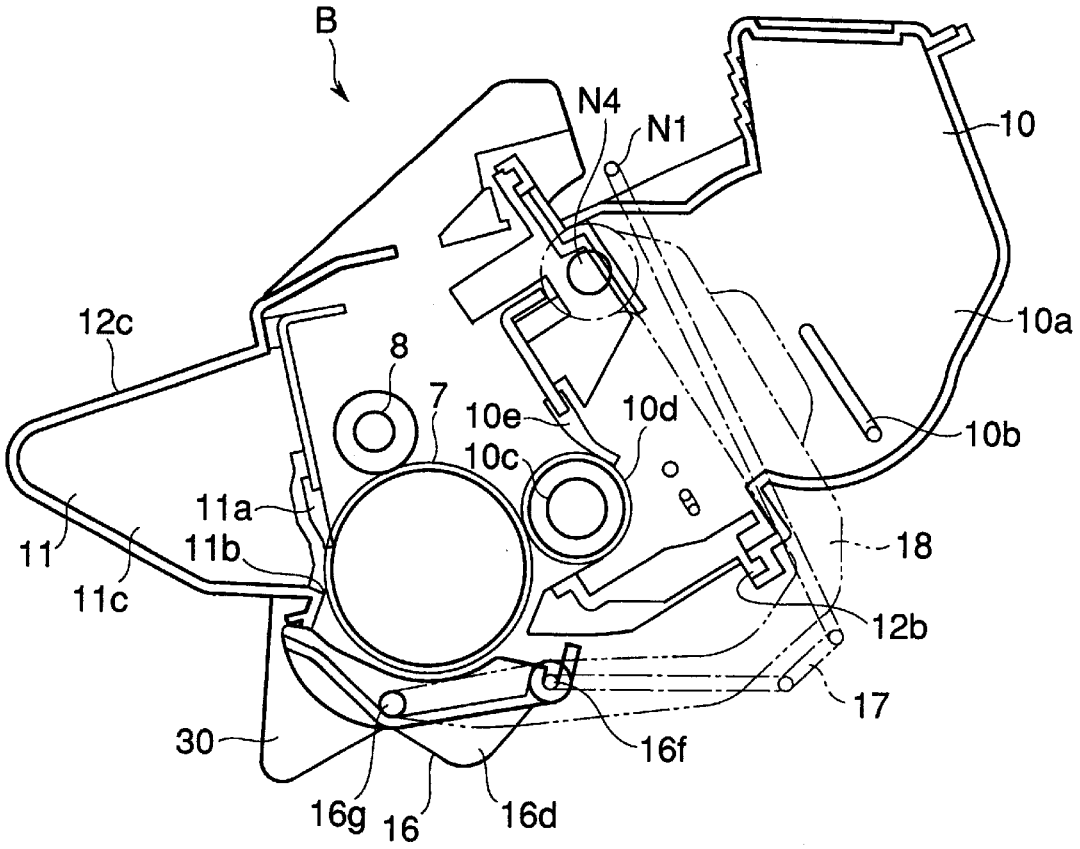
FIG. 11 is a schematic cross-sectional view of a process cartridge of a fourth embodiment of the present invention, along a plane perpendicular to the center line of the photosensitive drum.

In the present embodiment, as shown in FIG. 11, a projection 30 for engaging and functioning with the main body is provided in the vicinity of an end of the process cartridge B. For example, if the operator forgets to return the transport guide 25 (FIG. 3) to the original position after the jammed sheet disposal, the projection 30 pushes the transport guide 25 and returns it to the original position in mounting of the cartridge B. The projection 30 is provided at a side opposite to the side of the second arm 18.

Figure 12:
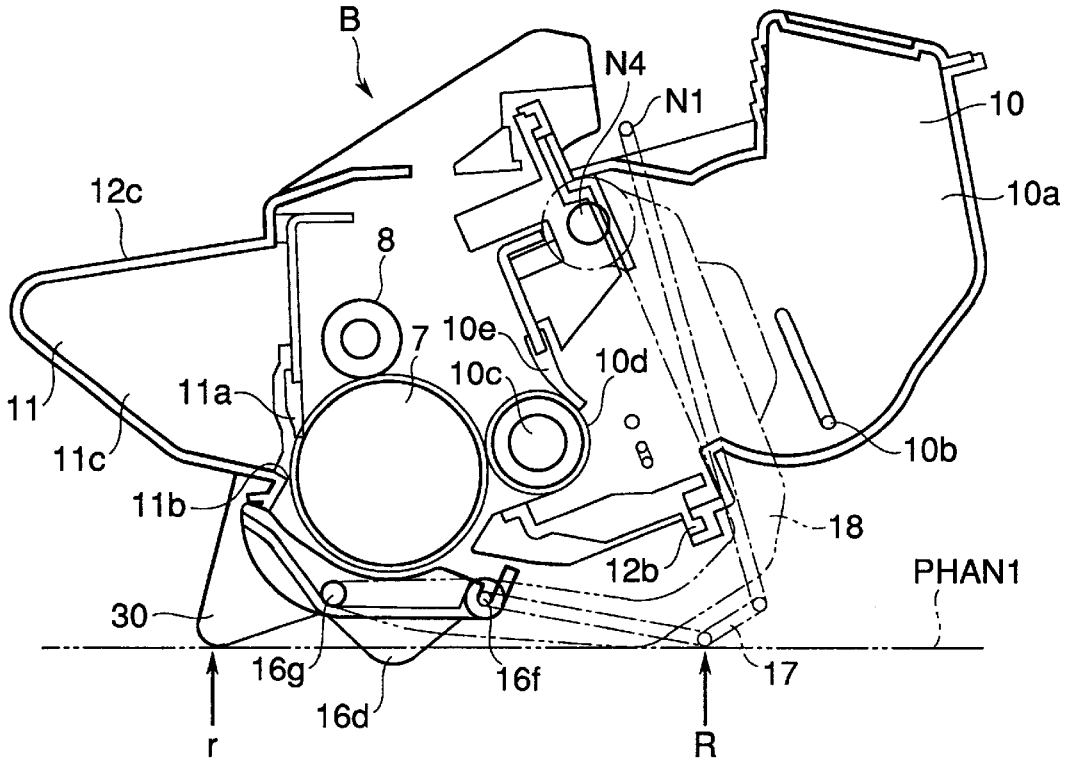
FIG. 12 is a schematic cross-sectional view showing a state of a process cartridge without projections placed on a horizontal plane.

In case such projection 30 is provided, the manner of contact of the cartridge B, when it is taken out of the image forming apparatus A and is placed, for example, on the desk surface, becomes different from that of the third embodiment. For this reason, at the side of the projection 30, there is also provided a projection 16*d*, which is so provided as to protrude outwards, as shown in FIG. 12, from a line (double-dotted chain line PHAN1 in FIG. 12) connecting the contact points of the projection 30 and the first arm 17 at which the cartridge B contacts the desk surface in the absence of the projection 16*d* as shown in FIG. 12.

Figure 13:
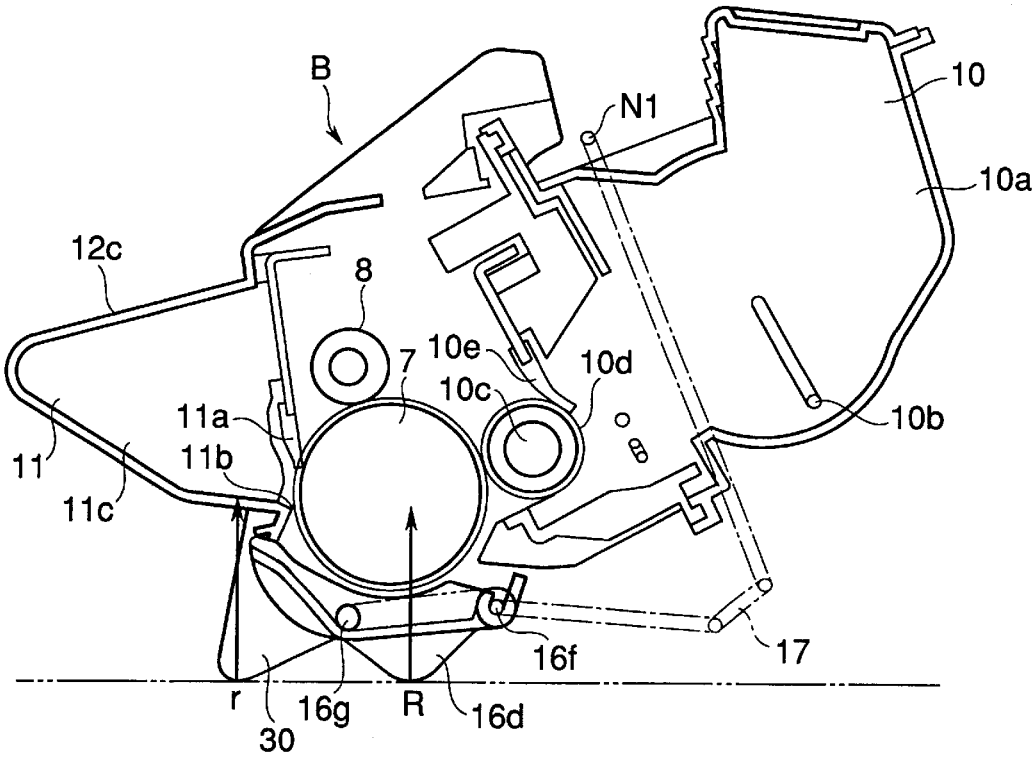
FIGS. 13 and 14 are schematic cross-sectional views showing a state of the process cartridge of the fourth embodiment placed on a horizontal plane.
Figure 14:
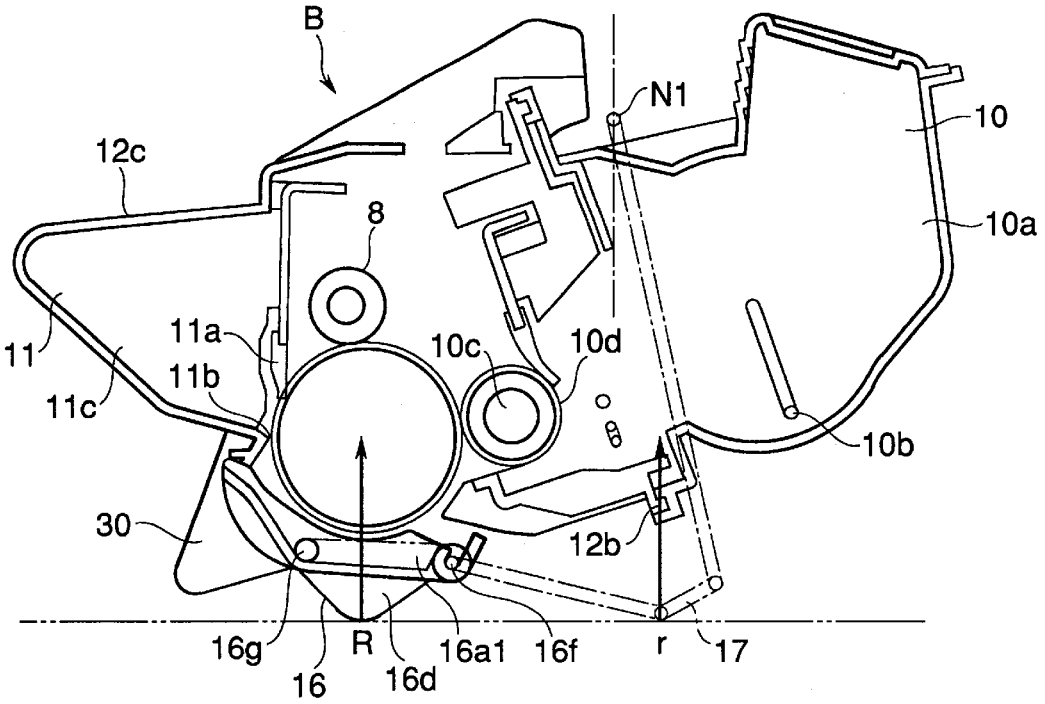

In the presence of the projection 16*d*, the cartridge B, including the shutter cover 16, comes into contact with the desk surface at two points, namely either at the projections 30 and 16*d* as shown in FIG. 13 or at the projection 16*d* and the first arm 17 as shown in FIG. 14. In the state shown in FIG. 13, the two reactive forces R, r both generate moments, about the articulation N1, in a direction to close the drum shutter 16. In the state shown in FIG. 14, the reactive forces R, r mutually complete across the articulation N1, but the first arm 17 is flexible. Consequently the first arm 17 is bent until an internal projection 16*a*1 of the shutter cover 16 contacts the photosensitive drum 7, and the frictional force generated by such contact stabilizes the shutter cover 16. Consequently the drum shutter is stabilized in the closed state.

In this manner the projection 16*d* prevents the drum shutter 16 from being opened.

The process cartridge of the aforementioned embodiments has the following configuration:

a process cartridge detachably mountable in the main body of an electrophotographic image forming apparatus, comprising:

(a) an electrophotographic photosensitive drum (7);

(b) process means acting on the electrophotographic photosensitive drum (7); and (c) a shutter including:

a protective portion (16*e*) mounted among the longitudinal direction of the electrophotographic photosensitive drum for protecting the same;

outward protruding portions (projections 16*b*1, 16*b*2) provided at one end and the other end of the protective portion (16*e*) in the longitudinal direction thereof so as to protrude from the surface thereof positioned outside, wherein the outward protruding portions (16*b*1, 16*b*2) are positioned outside the image forming area (I.A.) of the electrophotographic photosensitive drum in the longitudinal direction of the protective portion (16*e*); and inward protruding portions (projections 16*a*1, 16*a*2) provided at one end and the other end of the protective portion (16*e*) in the longitudinal direction thereof so as to protrude from the surface thereof positioned inside.

[Shutter cover]

In the following there will be explained, with reference to FIGS. 15 to 18, a shutter cover applicable to the foregoing embodiments 1 to 4.

Figure 15:
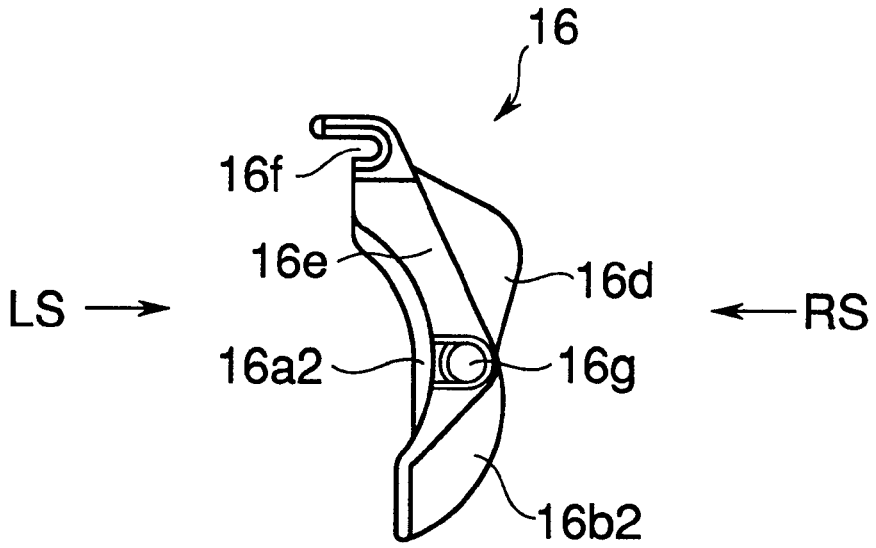
FIG. 15 is an elevational view of the shutter cover of the first, second, third and fourth embodiment of the present invention.
Figure 16:
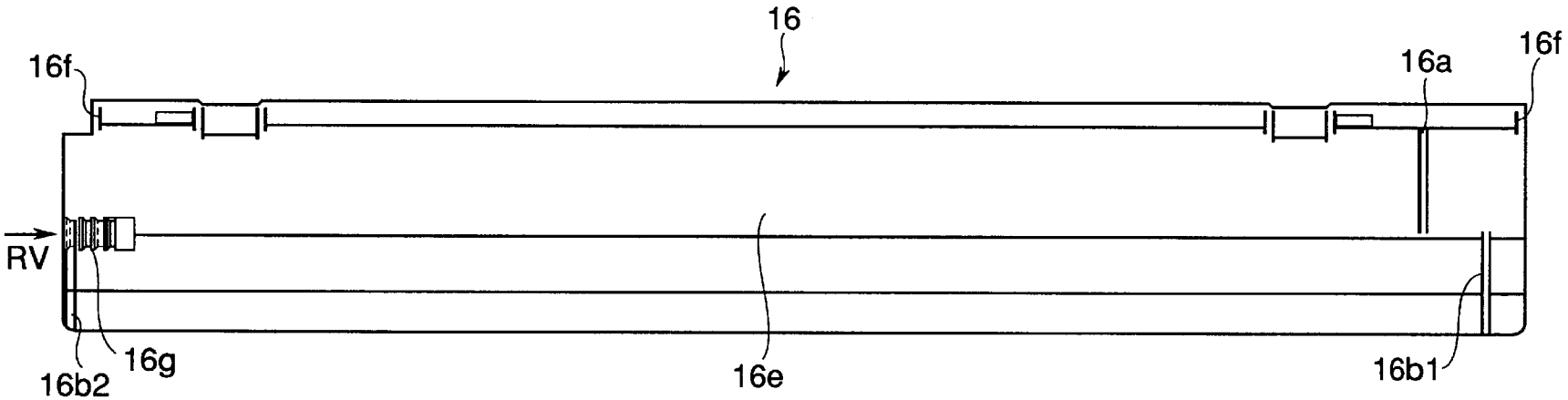
FIG. 16 is a left-side lateral view of the shutter cover of the first, second, third and fourth embodiment of the present invention.
Figure 17:
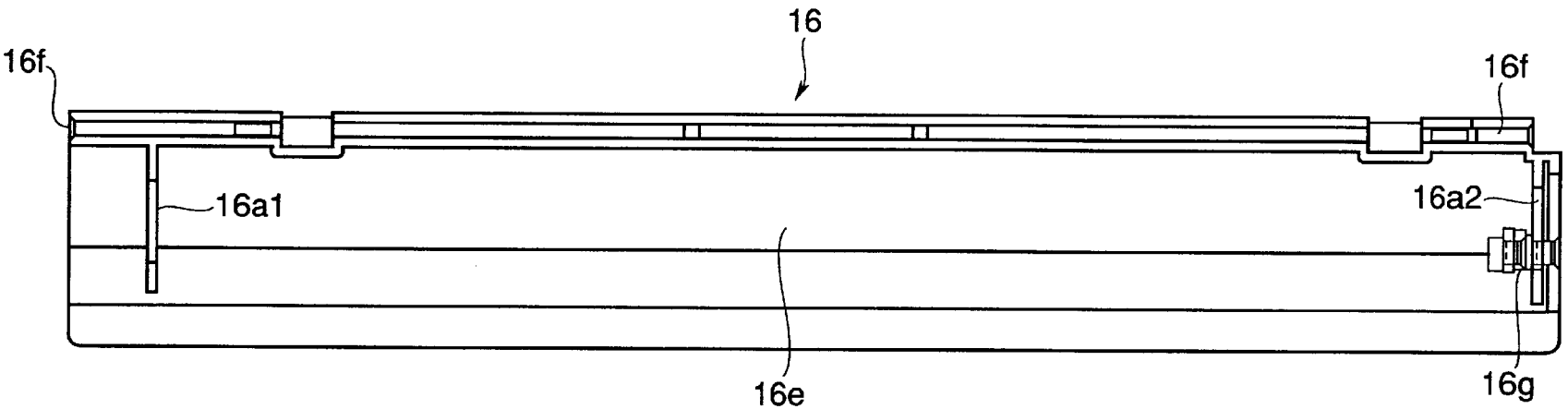
FIG. 17 is a right-side lateral view of the shutter cover of the first, second, third and fourth embodiment of the present invention.
Figure 18:
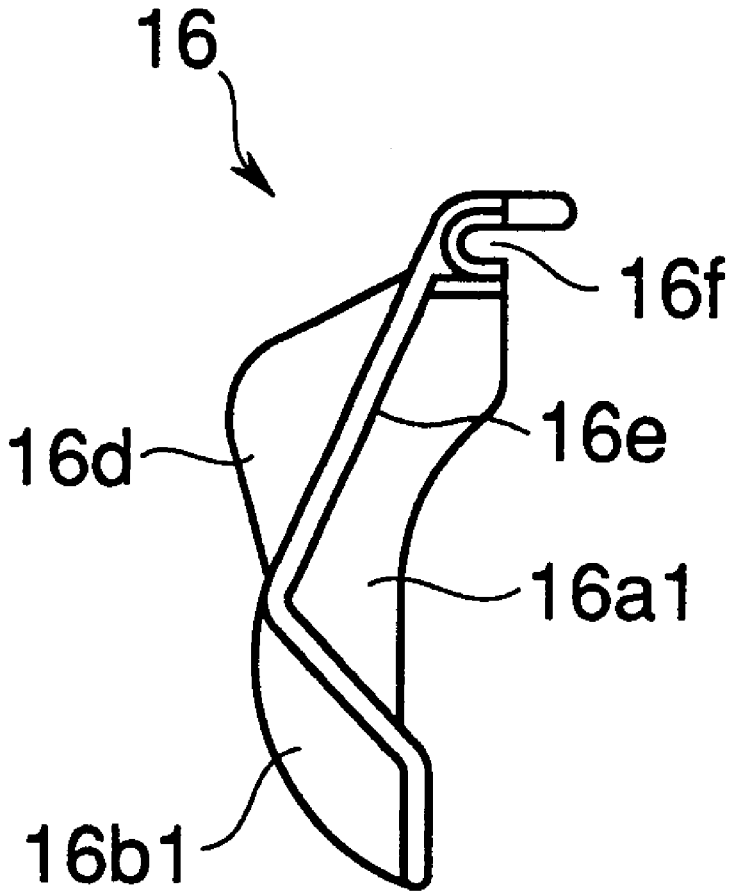
FIG. 18 is a rear-side view of the shutter cover of the first, second, third and fourth embodiment of the present invention.

FIGS. 15, 16, 17 and 18 illustrate a shutter cover applicable to the embodiments 1 to 4, respectively in an elevational view, a right-side lateral view of the shutter cover shown in FIG. 15, seen from a direction RS, a left-side lateral view seen from a direction LS, and a rear-side view seen from a direction RV.

The shutter cover 16 has the following configuration.

A shutter (16) to be used in a process cartridge (B) detachably mountable to the main body of an electrophotographic image forming apparatus and protects an electrophotographic photosensitive drum (7) provided in the process cartridge, the shutter comprising:

(a) a protective portion (16*e*) mounted on the electrophotographic photosensitive drum (7) along the longitudinal direction thereof for protecting the electrophotographic photosensitive drum, when the shutter is mounted on the process cartridge (B);

(b) outward protruding portions (protrusions 16*b*1, 16*b*2) provided at one end and the other end of the protective portion (16*e*) in the longitudinal direction thereof so as to protrude from the surface thereof positioned outside, when the shutter (16) is mounted on the process cartridge, the outward protruding portions (protrusions 16*b*1, 16*b*2) being positioned outside an image forming area (I.A.) of the electrophotographic photosensitive drum (7) in the longitudinal direction of the protective portion (16*e*); and (c) inward protruding portions (protrusions 16*a*1, 16*a*2) provided at one end and the other end of the protective portion (16*e*) in the longitudinal direction thereof so as to protrude from the surface thereof positioned inside, when the shutter (16) is mounted on the process cartridge (B).

The outward protruding portions (protrusions 16*b*1, 16*b*2) have a fan shape when seen from the longitudinal direction of the protective portion (16*e*). The outward protruding portions (protrusions 16*b*1, 16*b*2) are positioned upstream of the shutter (16) in the opening direction thereof when it is mounted on the process cartridge (B), the opening direction of the shutter corresponding to a direction in which the shutter is retracted from a position covering the electrophotographic photosensitive drum (7).

The inward protruding portions (protrusions 16*a*1, 16*a*2) have a shape with a curved surface of a radius of curvature equal to or larger than the radius of the electrophotographic photosensitive drum (7), seen from the longitudinal direction of the protective portion (16*e*), when the shutter (16.) is mounted on the process cartridge (B). The inward protruding portions (protrusions 16*a*1, 16*a*2) are so positioned as to be contacted an image non-forming area of the electrophotographic photosensitive drum, when the shutter (16) is mounted on the process cartridge (B) and is positioned at a closed position. The inward protruding portions (protrusions 16*a*1, 16*a*2) are positioned downstream of the shutter in the opening direction of the shutter, when the shutter is mounted on the process cartridge (B), the opening direction of the shutter corresponding to a direction in which the shutter is retracted from a position covering the electrophotographic photosensitive drum (7).

The protective portion (16*e*) includes an impinging projection (protrusion 16*d*) positioned at one end of the protective portion in the longitudinal direction thereof so as to protrude from the surface thereof positioned outside when the shutter (16) is mounted on the process cartridge (B), the impinging projection being positioned downstream of the outward protruding portions (protrusions 16*b*1, 16*b*2) in the opening direction of the shutter.

The protective portion (16*e*), outward protruding portions (protrusions 16*b*1, 16*b*2) and inward protruding portions (protrusions 16*a*1, 16*a*2) are integrally molded with a plastic material.

In FIGS. 15 to 18, there are shown a first engaging portion 16*f* for engaging with the first arm, and a second engaging portion 16*g* for engaging with the second arm.

As explained in the foregoing, as the protective member is spaced by the projection from the desk surface, it does not come into contact with a small object eventually present on. the desk surface. Consequently the electrophotographic photosensitive drum is not damaged by the protective member.

Also a projection is provided at the opposite side of the electrophotographic photosensitive drum, at the outside in the longitudinal direction, of the projection, of the projection of the protective member at the side of the electrophotographic photosensitive drum. Such configuration more securely prevents the electrophotographic photosensitive drum from being damaged.

Besides, the first and second arms are made flexible so that, when an external force is applied, the projections come into contact with the electrophotographic photosensitive drum and function as brakes. Thus, when the process cartridge is placed for example on the desk surface, the protective member can be prevented from opening thereby exposing the electrophotographic photosensitive member.

As explained in the foregoing, the present invention can protect the electrophotographic photosensitive drum.

What is claimed is:

1. A shutter to be used in a process cartridge detachably mountable to the main body of an electrophotographic image forming apparatus for protecting an electrophotographic photosensitive drum provided in said process cartridge, the shutter comprising:

(a) a protective portion to be mounted on the electrophotographic photosensitive drum along the longitudinal direction of the electrophotographic photosensitive drum for protecting the electrophotographic photosensitive drum, when said shutter is mounted on the process cartridge;

(b) outward protruding portions provided at one end and the other end of said protective portion in the longitudinal direction thereof so as to protrude from the surface thereof positioned outside when said shutter is mounted on the process cartridge, said outward protruding portions being positioned outside an image forming area of the electrophotographic photosensitive drum in the longitudinal direction of said protective portion; and (c) inward protruding portions provided at one end and the other end of said protective portion in the longitudinal direction thereof so as to protrude from the surface thereof positioned inside when said shutter is mounted on the process cartridge.

2. A shutter according to claim 1, wherein said outward protruding portions have a fan shape when seen from the longitudinal direction of said protective portion.

3. A shutter according to claim 2, wherein said outward protruding portions are positioned upstream of said shutter in the opening direction thereof when it is mounted on the process cartridge, said opening direction of said shutter corresponding to a direction in which said shutter is retracted from a position covering the electrophotographic photosensitive drum.

4. A shutter according to claim 1, wherein said inward protruding portions have a shape with a curved surface of a radius of curvature equal to or larger than the radius of the electrophotographic photosensitive drum, seen from the longitudinal direction of said protective portion when said shutter is mounted on the process cartridge.

5. A shutter according to claim 1, wherein said inward protruding portions are so positioned as to contact an image non-forming area of the electrophotographic photosensitive drum when said shutter is mounted on the process cartridge and is positioned at a closed position, wherein said inward protruding portions are disposed on a more inner side than said outward protruding portions in the longitudinal direction of said shutter.

6. A shutter according to claim 1, wherein said inward protruding portions are positioned on a downstream side of leading ends of said outward protruding portions of said shutter in the opening direction of said shutter when said shutter is mounted on the process cartridge, the opening direction of said shutter corresponding to a direction in which said shutter is retracted from a position covering the electrophotographic photosensitive drum.

7. A shutter according to claim 1, wherein said protective portion includes an impinging projection positioned at one end of said protective portion in the longitudinal direction thereof so as to protrude from the surface thereof positioned outside when said shutter is mounted on the process cartridge, said impinging projection being positioned downstream of said outward protruding portions in the opening direction of said shutter.

8. A shutter according to claim 1, 2, 3, 4, 5, 6, or 7, wherein said protective portion, said outward protruding portions and said inward protruding portions are integrally molded with a plastic material.

9. A process cartridge detachably mountable on the main body of an electrophotographic image forming apparatus, comprising:

(a) an electrophotographic photosensitive drum;

(b) process means acting on said electrophotographic photosensitive drum; and (c) a shutter including:

a protective portion provided along the longitudinal direction of said electrophotographic photosensitive drum for protecting said electrophotographic photosensitive drum;

outward protruding portions provided at one end and the other end of said protective portion in the longitudinal direction thereof so as to protrude from the surface thereof positioned outside, said outward protruding portions being positioned outside an image forming area of said electrophotographic photosensitive drum in the longitudinal direction of said protective portion; and inward protruding portions provided at one end and the other end of said protective portion in the longitudinal direction thereof so as to protrude from the surface thereof positioned inside.

10. A process cartridge according to claim 9, wherein said outward protruding portions have a fan shape when seen from the longitudinal direction of said protective portion.

11. A process cartridge according to claim 10, wherein said outward protruding portions are positioned upstream of said shutter, in the opening direction thereof, said opening direction of said shutter corresponding to a direction in which said shutter is retracted from a position covering said electrophotographic photosensitive drum.

12. A process cartridge according to claim 9, wherein said inward protruding portions have a shape with a curved surface of a radius of curvature equal to or larger than the radius of said electrophotographic photosensitive drum, seen from the longitudinal direction of said protective portion.

13. A process cartridge according to claim 9, wherein said inward protruding portions are so positioned as to contact an image non-forming area of said electrophotographic photosensitive drum when said shutter is located at a closed position, wherein said inward protruding portions are disposed on a more inner side than said outward protruding portions in the longitudinal direction of said shutter.

14. A process cartridge according to claim 9, wherein said inward protruding portions are positioned on a downstream side of leading ends of said outward protruding portions of said shutter in the opening direction thereof, the opening direction of said shutter corresponding to a direction in which said shutter is retracted from a position covering said electrophotographic photosensitive drum.

15. A process cartridge according to claim 9, wherein said protective portion includes an impinging projection positioned at one end of said protective portion in the longitudinal direction of said protective portion so as to protrude from the surface thereof positioned outside, wherein said impinging projection is positioned at the downstream side of said outward protruding portions in the opening direction of said shutter.

16. A process cartridge according to claim 9, 10, 11,12, 13, 14, or 15, wherein said protective portion, said outward protruding portions, and said inward protruding portions of said shutter are integrally molded with a plastic material.

* * * * *

UNITED STATES PATENT AND TRADEMARK OFFICE

CERTIFICATE OF CORRECTION

PATENT NO. : 6,236,822 B1
DATED : May 22, 2001
INVENTOR(S) : Hideshi Kawaguchi

It is certified that error appears in the above-identified patent and that said Letters Patent is hereby corrected as shown below:

Column 1,
Line 47, "damage." close up right margin
Line 49, "For" close up left margin Column 4,
Line 40, "of" should be deleted.
Line 41, "of" should be deleted.

Column 5,
Line 36, "there is" should be deleted.
Line 37, "not inducted a contact" should read -- no contact is inducted --.

Column 6,
Line 28, "engages" should read -- engage --.
Line 39, "a" should be deleted.

Column 7,
Line 46, "complete" should read -- compete --.

Column 8,
Line 24, "to" should read -- is to --.
Line 66, "be" should read -- make --.
Line 67, "contacted" should read -- contact with --.

Column 9,
Line 25, "on." should read -- on --.

Signed and Sealed this

Thirtieth Day of April, 2002

*Attest:*

*Attesting Officer*

JAMES E. ROGAN
*Director of the United States Patent and Trademark Office*